United States Patent [19]

Yazaki

[11] Patent Number: 4,866,351

[45] Date of Patent: Sep. 12, 1989

[54] ANNULAR LIGHT SOURCE UNIT USING ELECTRODELESS DISCHARGE AND A METHOD OF LIGHTING THE SAME

[75] Inventor: Yoshio Yazaki, Chofu, Japan

[73] Assignee: ORC Manufacturing Co. Ltd., Tokyo, Japan

[21] Appl. No.: 182,449

[22] Filed: Apr. 18, 1988

[30] Foreign Application Priority Data

Feb. 23, 1988 [JP] Japan ..... 63-40448

[51] Int. Cl.[4] ..... H05B 41/16; H01J 7/46

[52] U.S. Cl. ..... 315/248; 315/39; 315/111.21; 313/231.21; 313/231.61

[58] Field of Search ..... 315/248, 39, 267, 111.21; 250/504, 372; 313/231.31, 231.61

[56] References Cited

U.S. PATENT DOCUMENTS

| | | | |
|---|---|---|---|
| 4,070,603 | 1/1978 | Regan et al. | 315/248 |
| 4,498,029 | 2/1985 | Yoshizawa et al. | 315/39 |
| 4,633,140 | 12/1986 | Lynch et al. | 315/39 |
| 4,673,846 | 6/1987 | Yoshizawa et al. | 315/248 |
| 4,712,046 | 12/1967 | Butler et al. | 315/39 |
| 4,749,915 | 6/1988 | Lynch et al. | 315/39 |

*Primary Examiner*—Donald J. Yusko
*Assistant Examiner*—Brian Palladino
*Attorney, Agent, or Firm*—Cushman, Darby & Cushman

[57] ABSTRACT

Disclosed are an annular light source unit using electrodeless discharge and a method of lighting the same. The unit comprises an annular electrodeless discharge tube, a bowl-shaped microwave cavity device, and a plurality of microwave oscillators. The cavity unit is disposed in such a manner as to cover substantially the whole outer surface of the discharge tube excluding an underside thereof. The unit has slit antennas at a plurality of portions thereof prepared by dividing into substantially equal parts a whole circumferential portion thereof facing a whole circumferential surface of the discharge tube. The method comprises the step of individually sequentially starting the operations of the microwave oscillators after the stabilization of the discharge at a portion of the discharge tube in the vicinity of the corresponding slit antenna due to supply, therefrom, of microwave powers transmitted from the immediately preceding microwave oscillator.

4 Claims, 5 Drawing Sheets

ANNULAR LIGHT SOURCE UNIT USING ELECTRODELESS DISCHARGE AND A METHOD OF LIGHTING THE SAME

BACKGROUND OF THE INVENTION

1. FIELD OF THE INVENTION

The present invention relates to an annular light source unit using electrodeless discharge, which has an annular, i.e., circular or polygonal, doughnut-like electrodeless discharge tube which is excited with use of a microwave power to cause production, mainly, of ultraviolet rays, the ultraviolet rays being intended for use in photoengraving, cure of paint or ink, etc., and a method of lighting the same.

2. DESCRIPTION OF THE PRIOR ART

A conventional example of this type of light source unit using electrodeless discharge is disclosed in Japanese Patent Examined Publication No. 59-23613. This example has a slender electrodeless discharge tube in which there is sealed argon or mercury vapor, which is excited with use of a microwave power to cause the occurrence of a discharge phenomenon therein, to thereby cause production of ultraviolet rays.

In the above-mentioned official gazette, another conventional example also is disclosed, which has a spherical electrodeless discharge tube, which is excited with use of a microwave power for causing production of ultraviolet rays by way of a discharge phenomenon similar to that mentioned above.

Japanese Patent Examined Publication No. 55-35825 (U.S. Pat. No. 3,872,349) discloses still another conventional example of this type of light source unit using electrodeless discharge. The electrodeless discharge tube employed in this example is a slender linear one which is semicircular or circular in cross section, or is a small spherical one which serves as a point light source. The microwave power is used to excite the argon or mercury vapor which is sealed in the discharge tube of such shape. This excitation causes the occurrence of a discharge phenomenon in the argon or mercury vapor to cause production of ultraviolet rays.

Among the above-described conventional examples, however, the slender linear electrodeless discharge tube has a drawback in that it is difficult to excite the contents of the tube over an entire length thereof, uniformly, by supply of a microwave power and that, therefore, uniform emission of light over the entire length thereof is impossible.

Conventional electrodeless discharge tube in a spherical shape has also a drawback. A sphere is, in principle, the smallest in surface area of all shapes having an equal volume. Furthermore, the greater the diameter, the smaller the surface area per unit volume. Therefore, an increase in the diameter of the spherical electrodeless discharge tube to increase the amount of light emitted therefrom deteriorates cooling of the sphere and causes it to overheat.

SUMMARY OF THE INVENTION

In view of the above, it is an object of the present invention to provide an annular light source unit using electrodeless discharge, which has solved the above-mentioned problems inherent in the prior art, and a method of lighting the same.

To attain the above object, according to the present invention, there is provided an annular light source unit using electrodeless discharge, which comprises an annular electrodeless discharge tube, a bowl-shaped microwave cavity device so disposed as to cover substantially the whole outer surface of the annular electrodeless discharge tube excluding an underside thereof, the cavity device having at its lower end opening a member capable of cutting off a microwave power supplied into the cavity device but permitting the passage of light therethrough, the cavity device having slit antennas at a plurality of portions thereof prepared by dividing into substantially equal parts a whole circumferential portion thereof facing a whole circumferential surface of the annular electrodeless discharge tube, and a plurality of microwave oscillators each adapted for supplying a microwave power into the cavity device by way of its corresponding one of the slit antennas thereof.

Further, according to the present invention, there is also provided a method of lighting an annular light source unit using electrodeless discharge, which comprises the step of individually sequentially starting the operations of a plurality of microwave oscillators, each microwave oscillator being adapted for supplying a microwave power into a bowl-shaped microwave power cavity device containing therein an annular electrodeless discharge tube by way of a corresponding one of slit antennas formed in portions thereof prepared by dividing a whole circumferential portion thereof into substantially equal parts, after the stabilization of discharge at a portion of the electrodeless discharge tube in the vicinity of the corresponding slit antenna due to supply, therefrom, of microwaves generated from the preceding microwave oscillator.

In the annular light source unit using electrodeless discharge having the described construction, the bowl-shaped microwave cavity device is so disposed as to cover substantially the whole outer surface of the discharge tube excluding an underside thereof. The cavity device has at its lower end opening a member capable of cutting off a microwave power supplied into the cavity device but permitting the passage of light therethrough. Further, the cavity device has slit antennas at a plurality of portions thereof prepared by dividing into substantially equal parts a whole circumferential portion thereof facing a whole circumferential surface of the discharge tube. The microwave power is supplied from the slit antennas into the cavity device, whereby discharge occurs in an atmosphere of, for example, argon or mercury vapor sealed in the discharge tube, to cause production of ultraviolet rays.

Since the present electrodeless discharge tube is of an annular shape, an area thereof permitting the generation of light is large for the volume thereof. Accordingly, the amount of light generated also becomes large by that extent. In addition, uniform illumination over a wide range becomes possible. Also, heat dissipation is improved because the surface area of the discharge tube is large for the volume thereof.

By adopting the method of lighting the annular electrodeless discharge light source unit of the present invention, the microwave oscillators are prevented from interfering with each other at the time when discharge starts to occur in the discharge tube due to their oscillations. This eliminates the possibility that the microwave oscillators are destroyed or damaged due to their mutual interference.

DESCRIPTION OF THE PREFERRED EMBODIMENTS

Figure 1:
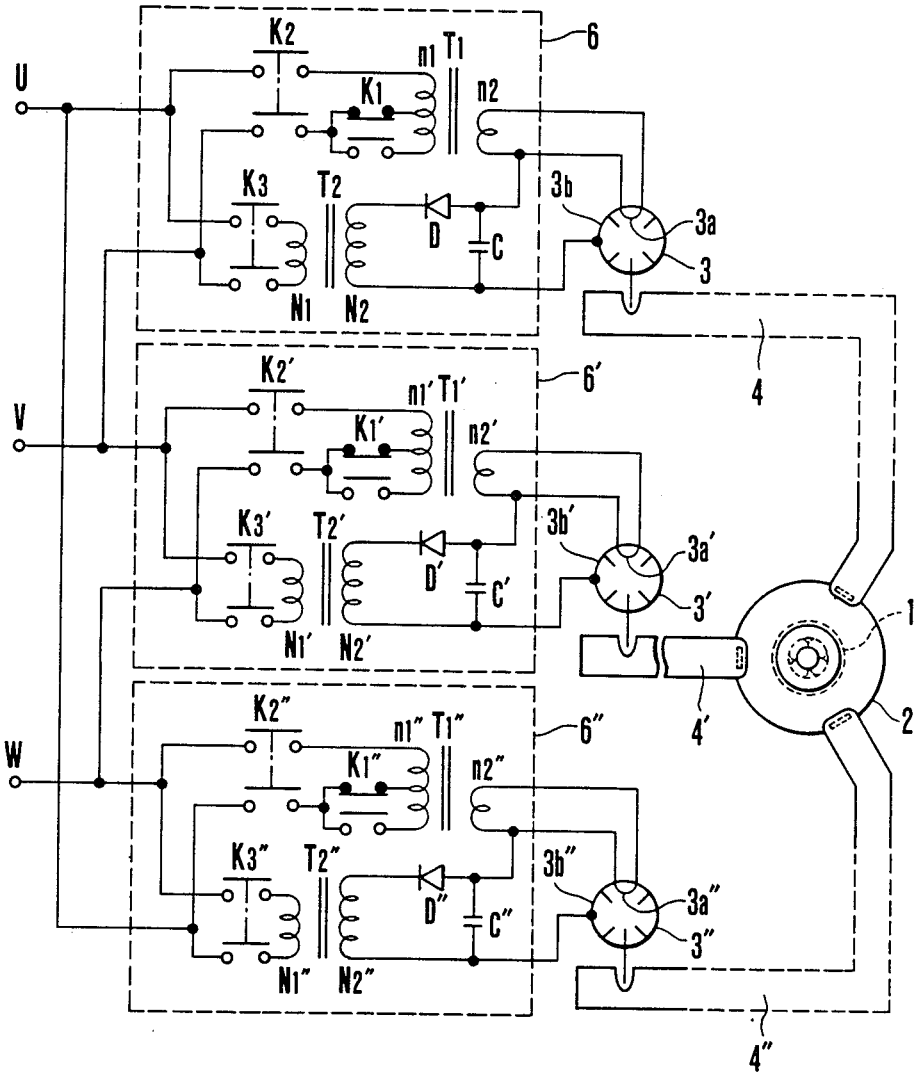
FIG. 1 is an electric circuit diagram of an annular electrodeless discharge light source unit according to an embodiment of the invention.
Figure 2:
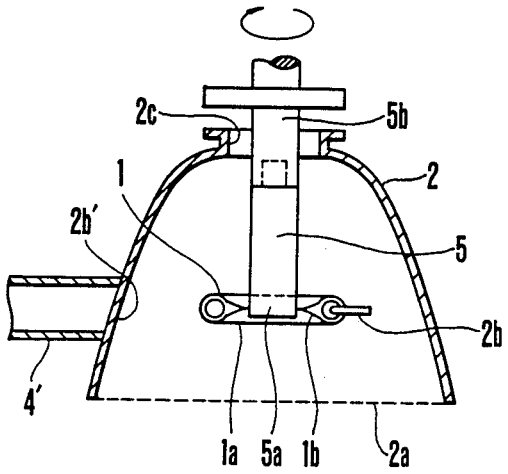
FIG. 2 is a side sectional view of a bowl-shaped microwave cavity device containing an annular electrodeless discharge tube.
Figure 3:
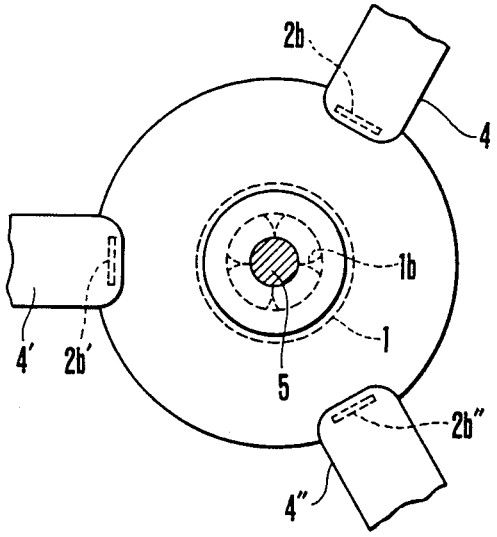
FIG. 3 is a plan view.

An embodiment of the present invention is illustrated in the drawings in which FIG. 1 shows an electric circuit of an annular electrodeless discharge light source unit according to the embodiment of the invention. As shown, microwave oscillators as later described are provided three in number and heater power sources and direct current power sources therefor are prepared from a commercially available three-phase frequency power source by way of transformers and rectifiers. Numeral 1 denotes an annular electrodeless discharge tube formed of, for example, silica glass, in which argon, mercury vapor, or the like is sealed. Numeral 2 denotes a bowl-shaped metallic microwave cavity device which is so disposed as to cover substantially the whole outer surface of the annular electrodeless discharge tube 1 excluding an underside 1*a* thereof. The microwave cavity device 2 is provided, at its lower end opening, with a member capable of cutting off the passage of a high frequency wave but permitting the passage of light rays therethrough, i.e., a metal mesh 2*a*. The microwave cavity device 2 is also provided with slit antennas 2*b*, 2*b*', and 2*b*'' at three portions thereof prepared by dividing into substantially equal parts a whole circumferential portion thereof facing a whole circumferential surface of the annular electrodeless tube 1, the slit antennas being utilized to supply into the cavity device 2 the microwave powers transmitted from the microwave oscillators as later described. The inner surface of the microwave cavity device 2 is wholly made a mirror surface so that it may reflect the incident light rays.

Numerals 3, 3' and 3'' denote the microwave oscillators which are constituted, generally, by magnetron, klystron, traveling-wave tube,or the like, but which are each constituted, in this embodiment, by magnetron.

Numerals 4, 4' and 4'' denote waveguides which are provided for supplying the microwaves generated from the microwave oscillators 3, 3' and 3'' to the microwave cavity device 2 by way of the slit antennas 2*b*, 2*b*' and 2*b*'' thereof.

The annular electrodeless discharge tube 1 is provided with claws 1*b* at several positions of its inner peripheral surface, the claws 1*b* being supported in such a way that they are retained on a lower end portion 5*a* of a supporting rod 5 suspended from above, the lower end portion 5*a* being formed of silica glass or ceramics material. That upper end portion 5*b* of the supporting rod 5 which is formed of metal is allowed to project upwardly outwardly from the cavity device 2 by way of a bore 2*c* formed in the top of the same. The clearance between the upper end portion 5*b* of the supporting rod 5 and a wall surface defining the bore 2*c* is set at a value which prevents the leakage of microwaves into outside the cavity device 2. Rotation of the supporting rod 5 at a suitable number of rotations would make it possible to provide a more uniform illumination with respect to a surface irradiated with the light rays generated, due to discharge, from the annular electrodeless discharge tube 1 supported by the lower end portion 5*a* of the supporting rod 5.

The distance between the slit antennas 2*b*, 2*b*' and 2*b*'' provided in the microwave cavity device 2 and the corresponding circumferential surface portions of the annular electrodeless discharge tube 1 is set at a value which permits the argon or mercury vapor sealed in the annular electrodeless discharge tube 1 to be highly efficiently excited to generate light rays by the action of the microwave power supplied from the slit antennas 2*b*, 2*b*' and 2*b*''.

Reference numerals 6, 6' and 6'' denote power source circuits for the microwave oscillators 3, 3' and 3'', respectively, the power source circuits being constructed as described below. That is, T1, T1' and T1'' designate transformers which are included in heater power sources for the microwave oscillators 3, 3' and 3'', respectively. Symbols n1, n1' and n1'' designate primary windings, respectively, the numbers of turns of which are changed over by operation of change-over switches K1, K1' and K1'', respectively. The transformers have secondary windings n2, n2' and n2'' as well which are connected to heaters 3*a*, 3*a*' and 3*a*'' of the microwave oscillators 3, 3' and 3'', respectively. Symbols T2, T2' and T2'' designate transformers which are included in plate power sources for the microwave oscillators 3, 3' and 3'', respectively. Symbols N1, N1' and N1'' designate primary windings of those transformers, and N2, N2' and N2'' secondary windings, respectively. By the actions of the rectifiers (diodes) D, D' and D'' and smoothing capacitors C, C' and C'' connected to the secondary windings N2, N2' and N2'', high direct current voltage power sources are prepared, the (+) poles of which are connected to plates 3*b*, 3*b*' and 3*b*'' of the microwave oscillators 3, 3' and 3'' and the (−) poles of which are connected to the ends at one side of the heaters 3*a*, 3*a*' and 3*a*'', the heaters 3*a*, 3*a*' and 3*a*'', therefore, serving concurrently as cathodes, respectively.

The transformers T1, T1' and T1'' in the heater power sources are connected in parallel to each other via heater power source switches K2, K2' and K2'', and at the same time are connected to commercially available three-phase frequency power sources U, V and W, respectively, while, on the other hand, the transformers T2, T2' and T2'' in the plate power sources are connected in parallel to each other via plate power source switches K3, K3' and K3'', and at the same time are connected to commercially available three-phase frequency power sources U, V and W, respectively, by delta connection.

The operation of the annular electrodeless discharge light source unit having the described construction will now be described below.

FIG. 1 shows a state wherein the light source unit is out of operation. In this state, the transformers T1, T1' and T1'' are in a condition wherein the numbers of turns of their primary windings n1, n1' and n'' are changed over, by the change-over switches K1, K1' and K1'', to a small value. Accordingly, when the heater power source switches K2, K2' and K2'' are closed, the secondary windings n2, n2' and n2'' come to have a heater voltage which is higher than that which is otherwise obtained.

First of all, explanation will be made of the lighting of the annular electrodeless discharge tube 1 in accordance with the operation of the microwave oscillators 3. When the heater power source switches K2, K2' and K2'' are simultaneously closed, since the primary windings n1, n1' and n'' of the heater power source transformers T1, T1' and T1'' are changed over in advance as above as illustrated, the heater voltage becomes higher than that which is normally obtained, with the result that the heaters 3*a*, 3*a*' and 3*a*'' of the microwave oscillators 3, 3' and 3'' are rapidly heated When, thereafter, the plate power source switch K3 is closed, a high alternating current voltage is obtained at the secondary winding N2 of the plate power source transformer T2, and this voltage is rectified by the rectifier D while, on the other hand, its pulsation is smoothed by the smoothing capacitor C, to become a high direct current voltage. This voltage is applied to the plate 3*b* of the microwave oscillator 3. After the lapse of a specified time period (from one of several parts of a second to several seconds), the discharge at a portion of the discharge tube 1 in the vicinity of the slit antenna 2*b* due to supply of microwave power from the microwave oscillator 3 is stabilized. When the discharge has been stabilized in this way, the change-over switch K1 is changed over so that the turns of the primary windings n1 may be increased. As a result, the heater voltage decreases to a level which is normal, or somewhat lower than the normal level. When, in this state, microwaves enter the microwave cavity device 2 by way of the waveguide 4 and of the slit antenna 2*b*, the microwave power is supplied into the discharge tube 1 by way of a circumferential surface portion thereof which is located near the slit antenna 2*b*. The argon or mercury vapor which is sealed in the discharge tube 1 is thereby excited with the result that a discharge phenomenon occurs therein to generate ultraviolet rays.

After the stabilization of the discharge at a portion of the discharge tube 1 due to the oscillation of the microwave oscillator 3, the oscillation of the next microwave oscillator 3' is started. To this end, the plate power source switch K3' is closed, so that the microwave power generated from the microwave oscillator 3' is supplied into the discharge tube 1 by way of a second circumferential surface portion thereof, from which ultraviolet rays are generated.

After the stabilization of the discharge at a second portion of the discharge tube 1 due to the oscillation of the microwave oscillator 3', the next microwave oscillator 3'' starts to be operated in the same manner as mentioned above. Thus, ultraviolet rays are generated from a final circumferential surface portion, as well, of the discharge tube 1.

As described above, the operations of the microwave oscillators 3, 3' and 3'' are sequentially started with the specified time lags therebetween, in such a manner that the microwave oscillator starts to be operated after the discharge at a certain portion of the discharge tube due to the operation of the immediately preceding microwave oscillator has come into a stable condition.

The reason for this is as follows. That is, when the microwave oscillator is operated during a time period in which the discharge at a certain portion of the discharge tube due to the operation of the immediately preceding oscillator is still in a condition of being unstable, the microwaves from that immediately preceding microwave oscillator interfere with the succeeding microwave oscillator at the start of the operation thereof, to raise an inconvenience that it is destroyed or damaged. Providing the above-mentioned time lags between the starts of the oscillator operations is for the purpose of eliminating such an inconvenience in advance.

The charge-over switches K1, K1' and K1'', the heater power source switches K2, K2' and K2Δ, and the plate power source switches K3, K3' and K3'' are each constituted, in this embodiment, by a relay-contact action or mechanism. The timings for the above-mentioned opening/closing of such relay-contact actions are controlled through operations of timers not shown. Further, although not shown, electronic switches may be substituted for such relay-contact switches, as another embodiment.

Figure 4:
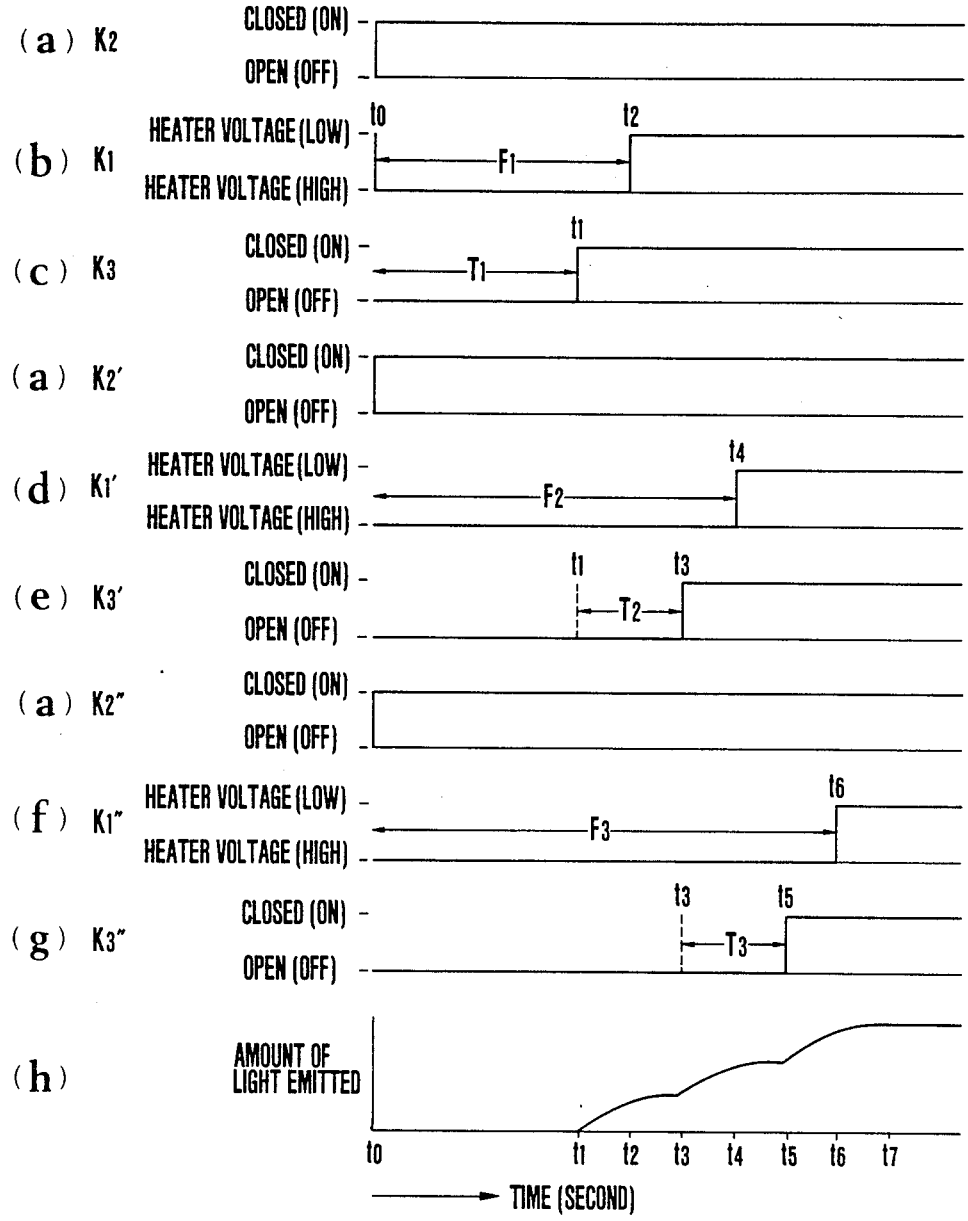
FIG. 4 is a timing chart for opening and closing of switches provided in the electric circuit.
Figure 5:
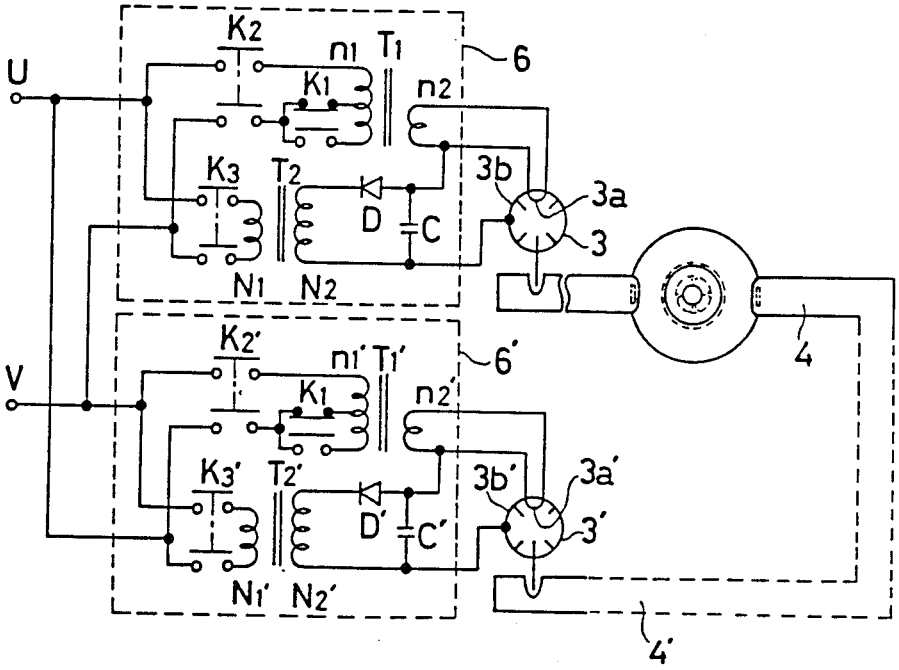
FIG. 5 is an electric circuit diagram of an annular electrodeless discharge light source unit having two microwave oscillators in accordance with an embodiment of the present invention.
Figure 6:
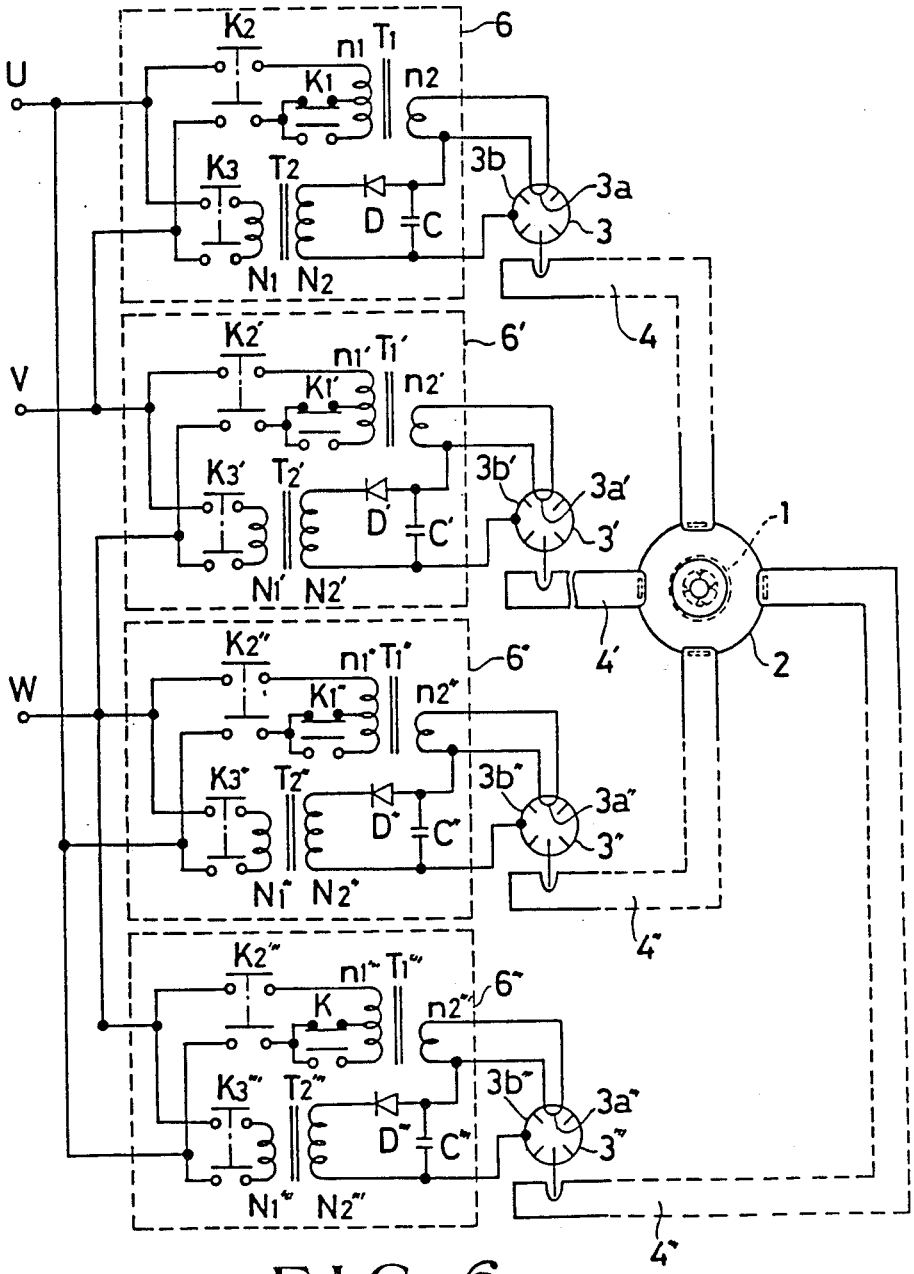
FIG. 6 is an electric circuit diagram of an annular electrodeless discharge light source unit having four microwave oscillators in accordance with another embodiment of the present invention.

The timings for opening/closing of the above-mentioned switches will now be explained in detail with reference to a timing chart shown in FIG. 4. FIG. 4(*a*) shows that the heater power source switches K2, K2' and K2'' for the microwave oscillators 3, 3' and 3'' are closed at a point of time $t_0$. FIG. 4(*c*) shows that the plate power source switch K3 for the microwave oscillator 3 is closed at a time t1 after the lapse of a time period T1 from the time $t_0$. The heater voltage which is applied to the microwave oscillator 3 is kept to be made slightly higher in level than the normal heater voltage for a time period F1 of from the time $t_0$ to the time $t_2$, by the illustrated change over of the change-over switch K1 in FIG. 4(*b*). During this period of time, the heater of the microwave oscillator 3 is sufficiently heated. It is to be noted that the time period F1 between the time $t_0$ and the time $t_2$ covers several seconds which are capable of preventing the heater from being damaged due to its own temperature and within which thermionic emission becomes possible.

The plate power switch K2' for the microwave oscillator 3'' is closed at a time $t_3$ as shown in FIG. 4(*e*). A time period T2 between the time $t_1$ and the time $t_3$ usually covers several milliseconds to several seconds, which are the time period required until the discharge in the discharge tube 1 due to the oscillation of the microwave oscillator 3' is stabilized and the light generated therefrom is thus uniformized. The heater voltage which is applied to the microwave oscillator 3' is kept to be slightly higher in level than the normal heater voltage for a time period F2 of from the time $t_0$ to a time $t_4$, by the illustrated change over of the change-over switch K1' in FIG. 4(*d*). After the passage of the time $t_4$, the change-over switch K1' is changed over to cause a decrease in level of the heater voltage.

The plate power source switch K3'' for the microwave oscillator 3'' is closed at a time $t_5$ as shown in FIG. 4(*g*). The time period T3 between the time $t_3$ and the time $t_5$ covers several milliseconds to several seconds, which are the time period required until the discharge in the discharge tube 1 due to the oscillation of the microwave oscillator 3'' is stabilized and the light generated therefrom is thus uniformized. The heater voltage which is applied to the microwave oscillator 3'' is kept to be slightly higher in level than the normal heater voltage for a time period F3 of from the time $t_0$ to a time $t_6$, by the illustrated change over of the change-over switch K1" in FIG. 4(*f*). After the passage of the time $t_6$, the change-over switch K1" is changed over to cause a decrease in level of the heater voltage.

FIG. 4(*h*) is a time chart showing a distribution, as taken relative to time, of the amount of light generated from the electrodeless discharge tube, the time chart indicating that the amount of light generated sequentially increases from the time $t_1$ toward a time $t_7$, at which the discharge in the discharge tube as a whole is stabilized.

In this embodiment, as described above, the microwave oscillators are provided three in number and the heater power sources and direct current power sources therefor are prepared from the commercially available three-phase frequency power source by way of the transformers and rectifiers. However, this is not limitative but the invention permits various modifications to be made. For example, the microwave oscillators may be provided two or four in number, in which state, heater power sources and direct current power sources therefor may be prepared from a commercially available single-phase frequency power source by way of transformers and rectifiers.

As has been described above, according to the present invention, the annular electrodeless discharge light source unit comprises an annular electrodeless discharge tube, a bowl-shaped microwave cavity device so disposed as to cover substantially the whole outer surface of the annular electrodeless discharge tube excluding an underside thereof, the cavity device having at its lower end opening a member capable of cutting off a microwave power supplied into the cavity device but permitting the passage of light therethrough, the cavity device having slit antennas at a plurality of portions thereof prepared by dividing into substantially equal parts a whole circumferential portion thereof facing a whole circumferential surface of the annular electrodeless discharge tube, and a plurality of microwave oscillators each adapted for supplying a microwave power into the cavity device by way of its corresponding one of the slit antennas thereof. For this reason, when a microwave power has been supplied into the annular electrodeless discharge tube via each slit antenna of the cavity device, argon or mercury vapor for example which is sealed in that discharge tube is excited with the result that discharge occurs therein to cause the generation of ultraviolet rays. In this case, since the discharge tube is of an annular shape, the area thereof which permits the generation of light is relatively large and, hence, the amount of light generated also is large by that extent. This makes it possible to provide a uniform illumination over a wide range. In addition, since the surface area of the discharge tube is large for the volume thereof, heat dissipation therefor is also improved.

Further, according to the present invention, the method of lighting the annular electrodeless discharge light source unit comprises the step of individually sequentially starting the operations of a plurality of microwave oscillators, each microwave oscillator being adapted for supplying a microwave power into a bowl-shaped microwave cavity device containing therein an annular electrodeless discharge tube by way of one of the slit antennas formed in portions thereof prepared by dividing a whole circumferential portion thereof into substantially equal parts, after the stabilization of the discharge at a portion of the discharge tube in the vicinity of the corresponding slit antenna due to supply, therefrom, of microwaves generated from the immediately preceding oscillator. For this reason, it is possible to prevent the microwave oscillators from interfering with each other at the start of the discharge in the discharge tube due to the oscillations thereof to raise an inconvenience of destroying the oscillators as in the case of simultaneously operating the oscillators.

What is claimed is:

1. An annular light source unit using electrodeless discharge comprising an annular electrodeless discharge tube, a bowl-shaped microwave power supply cavity device so disposed as to cover substantially the whole outer surface of said annular electrodeless discharge tube excluding an underside thereof, said cavity device having at its lower end opening a member capable of cutting off a microwave supplied into said cavity device but permitting the passage of light therethrough, said cavity device having slit antennas at a plurality of portions thereof prepared by dividing into substantially equal parts a whole circumferential portion thereof facing a whole circumferential surface of said annular electrodeless discharge tube, and a plurality of microwave oscillators each adapted for supplying a microwave power into said cavity device by way of its corresponding one of said slit antennas thereof.

2. An annular light source unit as set forth in claim 1, wherein said microwave oscillators are three in number; and heater power sources and direct current power sources therefor are prepared from a commercially available three-phase frequency power source by way of transformers and rectifiers.

3. An annular light source unit as set forth in claim 1, wherein said microwave oscillators are two or four in number; and heater power sources and direct current power sources therefor are prepared from a commercially available single-phase frequency power source by way of transformers and rectifiers.

4. A method of lighting an annular light source unit using electrodeless discharge comprising the step of individually sequentially starting the operations of a plurality of microwave oscillators, each microwave oscillator being adapted for supplying a microwave power into a bowl-shaped microwave cavity device containing therein an annular electrodeless discharge tube by way of one of slit antennas formed in portions thereof prepared by dividing a whole circumferential portion thereof into substantially equal parts, after stabilization of the discharge at a portion of said electrodeless discharge tube in the vicinity of corresponding said slit antenna due to supply, therefrom, of microwaves generated from the immediately preceding microwave oscillator.

* * * * *